US006622869B1

(12) United States Patent
Riggenmann et al.

(10) Patent No.: US 6,622,869 B1
(45) Date of Patent: Sep. 23, 2003

(54) SEPARATING DEVICE FOR SOLIDS AND METHOD FOR SEPARATING SOLIDS

(75) Inventors: Reinhold Riggenmann, Weissenhorn (DE); Winfried Von Rhein, Freigericht (DE); Helmut Werdinig, Nürnberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/718,936

(22) Filed: Nov. 22, 2000

Related U.S. Application Data

(63) Continuation of application No. PCT/DE99/01502, filed on May 19, 1999.

(30) Foreign Application Priority Data

May 22, 1998 (DE) ..... 198 23 019

(51) Int. Cl.[7] ..... B07B 1/10
(52) U.S. Cl. ..... 209/307; 209/665
(58) Field of Search ..... 209/307, 659, 209/660, 665, 681

(56) References Cited

U.S. PATENT DOCUMENTS

| | | | | |
|---|---|---|---|---|
| 973,597 A | | 10/1910 | Wedge | 209/307 |
| 3,002,618 A | * | 10/1961 | Derderian et al. | 209/307 X |
| 3,631,980 A | * | 1/1972 | Hamachek, III | 209/307 X |
| 4,535,894 A | * | 8/1985 | Shell | 209/665 |
| 5,033,932 A | * | 7/1991 | Compton | 209/681 X |

FOREIGN PATENT DOCUMENTS

| | | | | |
|---|---|---|---|---|
| CH | 677738 A5 | | 6/1991 | |
| DE | 2 135 035 | | 2/1973 | |
| DE | 2 311 315 | | 9/1974 | |
| DE | 29 46 312 A1 | | 5/1981 | |
| DE | 31 15 852 A1 | | 1/1982 | |
| DE | 195 11 931 C1 | | 1/1996 | |
| EP | 0 038 554 A1 | | 10/1981 | |
| EP | 038554 | * | 10/1981 | 209/307 |
| EP | 0 302 310 A1 | | 2/1989 | |
| JP | 2-261111 | * | 10/1990 | 209/307 |

OTHER PUBLICATIONS

"Die Schwel–Brenn–Anlage–Eine Verfahrensbeschreibung", Siemens Bereich Energieerzeugung, KWU Umwelttechnik, pp. 1–24 plus 10 sheets of drawings (A smouldering combustion plant–a method description).

* cited by examiner

*Primary Examiner*—Tuan N. Nguyen
(74) *Attorney, Agent, or Firm*—Laurence A. Greenberg; Werner H. Stemer; Gregory L. Mayback

(57) ABSTRACT

In order to enable a reliable and continuous separation of a solid material, a separating device includes a moving belt which revolves around deflection rollers. Transverse strips and longitudinal strips are provided on the moving belt. The transverse and longitudinal strips form screen surfaces. Solid material having a predetermined maximum dimension falls through these screen surfaces. The portions of solid material which are caught between the transverse strips are automatically loosened when the moving belt moves. In addition, portions of solid material which are caught between the longitudinal strips are removed by a cleaning rake thus guaranteeing an uninterrupted operation. The separating device is especially suited for separating pyrolysis residual material. A method of separating solid material is also provided.

18 Claims, 5 Drawing Sheets

SEPARATING DEVICE FOR SOLIDS AND METHOD FOR SEPARATING SOLIDS

CROSS-REFERENCE TO RELATED APPLICATION

This application is a continuation of copending International Application No. PCT/DE99/01502, filed May 19, 1999, which designated the United States.

BACKGROUND OF THE INVENTION

Field of the Invention

The invention relates to a separating device and to a method for separating solids, such that coarse solid constituents are separated from fine solid constituents.

In many fields in the industry, it is necessary to separate solids, which are contained, for example, in bulk material, into a plurality of constituents or fractions. The constituents are, as a rule, subdivided according to different sizes, geometries, or compositions. A separation of the solids is desirable whenever the different solid constituents are provided for further treatment.

In the building industry, for example, building debris is separated from large and bulky debris constituents which can then be sorted and reutilized. The separated finer building debris is disposed of, for example, on a dump provided for this purpose.

In the field of waste disposal, the separation and sorting of the waste or of residues occurring during waste utilization are of increasing importance in view of a disposal which protects the environment as much as possible. An essential factor in this is separation of the waste according to its size. Separation may be carried out before the waste is utilized; however, it may also be an essential method step during waste utilization itself.

For waste elimination, thermal methods are known, in which the waste is burnt in refuse incineration plants or is pyrolyzed in pyrolysis plants, that is to say subjected to a temperature of about 400° C. to 700° C. with the exclusion of air. In both methods, it is expedient to separate the residue remaining after incineration or after pyrolysis, in order either to supply it for reutilization or to dispose of it in a suitable way. In this case, the aim is to keep the residue to be ultimately stored on a dump as low as possible.

European Patent EP 0 302 310 and the company publication "Die Schwel-Brenn-Anlage, eine verfahrensbeschreibung" ["The Low-Temperature Carbonization Incineration Plant, a Process Description"], published by Siemens A G, Berlin and Munich, 1996, disclose as a pyrolysis plant, a so-called low-temperature carbonization incineration plant, in which essentially a two-stage method is carried out. In the first stage, the waste delivered is introduced into a low-temperature carbonization drum (pyrolysis reactor) and is carbonized at low temperature (pyrolyzed). During pyrolysis, low-temperature carbonization gas and pyrolysis residue form in the low-temperature carbonization drum. The low-temperature carbonization gas is burnt, together with combustible parts of the pyrolysis residue, in a high-temperature combustion chamber at temperatures of approximately 1200° C. The waste gases occurring in the process are subsequently purified.

The pyrolysis residue also has non-combustible constituents in addition to combustible parts. The non-combustible constituents are composed essentially of an inert fraction, such as glass, stones or ceramic, and of a metal fraction. The useful materials of the residue are sorted out and recycled. For sorting purposes, it is necessary to have methods and components which ensure reliable and continuous operation.

In the case of screening or separating devices, there is often the problem that the screen surfaces become clogged. The separating device then breaks down or has to undergo, at least, complicated and labour-intensive cleaning. The problem of the blockage of separating devices arises, in particular, when the solids to be separated have a highly inhomogeneous composition. Thus, for example, wires catch in perforated plates used as screen surfaces, so that the individual holes S are initially narrowed and, in time, become clogged. Moreover, for specific uses, the separated solid fragments should not exceed a maximum size.

The residue occurring during pyrolysis is typically a highly inhomogeneous solid of this kind, which has pronounced differences as regards its material composition, its size and the geometry of its solid fragments. The residue also contains, in addition to stones, broken glass and larger metal fragments, elongate bars or entangled wires (wire pellets).

SUMMARY OF THE INVENTION

It is accordingly an object of the invention to provide a separating device and a method for separating solids, which overcome the above-mentioned disadvantages of the heretofore-known devices and methods of this general type and which allow a continuous operation with simple measures and which ensure that only solid constituents up to a maximum dimension are separated.

With the foregoing and other objects in view there is provided, in accordance with the invention, a separating device for separating solids, including:

at least two deflecting rollers;

a moving belt rotating about the at least two deflecting rollers, the moving belt defining a conveying direction;

transverse strips or plates fastened to the moving belt, the transverse strips being spaced from one another and extending transversely to the conveying direction, the transverse strips defining fall-through orifices for solids, the fall-through orifices defining a plane; and a feed device for feeding the solids, the feed device being configured such that the solids are deposited at an acute angle, substantially parallel to the plane defined by the fall-through orifices.

Only solid fragments, the dimension of which is smaller than that of the fall-through orifices, fall through the fall-through or screening orifices. Larger solid fragments remain lying on the transverse strips and, lying on these, are transported further to the end of the separating device. The moving belt is preferably very narrow and serves primarily for the forward movement and the fastening of the transverse strips, which are provided, in particular, vertically on the moving belt, so that they form an elevation. For example, two moving belts are provided, which run parallel and next to one another and on which the transverse strips are fastened. The fall-through orifices are therefore delimited by the moving belts and by the transverse strips.

The particular advantage of the separating device is that a solid constituent or fraction, the dimension of which corresponds to the spacing between two successive transverse strips and which has been jammed between them, is automatically released at the end of the separating device in the region of the end-face deflecting roller. This is because, during rotation around the deflecting roller, the spacing between the two transverse strips widens and allows the solid fragment to fall down. The possibility of a blockage of the separating device is thus eliminated and continuous fault-free operation is ensured.

The separating device advantageously has a feed device for the solids, via which the solids can be applied essentially parallel to the plane formed by the fall-through orifices. For this purpose, the feed device preferably terminates directly above the moving belt, and its feed direction forms an acute angle with the conveying direction.

The solid fragments or constituents, in particular elongate solid fragments, supplied to the separating device are therefore fed, approximately parallel, to the plane formed by the fall-through orifices. This rules out the possibility of such elongate solid fragments falling vertically through the fall-through orifices.

Moreover, the configuration of the feed device directly above the moving belt or above the transverse strips prevents the parallel-aligned solid fragments from tilting vertically downwards and falling lengthways through the fall-through orifices. The smaller the acute angle of the feed device is, the more reliably elongate solid fragments are correctly separated according to their length. The feed direction may also run parallel to the conveying direction, in so far as the, for example, horizontally provided feed device has a separate conveying device, so that the solids can be supplied to the separating device, or in so far as the entire separating device, together with a feed device, is inclined relative to the horizontal.

For the alignment of elongate solid fragments, it is expedient, in particular, if an impermeable bottom is provided directly below the upper portion of the moving belt, the upper portion facing the feed device.

Elongate solid fragments striking the separating device at an angle first hit the impermeable bottom with their front end and cannot fall through lengthways. They remain lying, together with other large solid fragments, on the transverse strips and are transported further as far as the end of the separating device. The fine solids accumulate in the region of the bottom and are pushed forwards by the transverse strips to the fall-through orifice which follows in the conveying direction and through which the fine solids fall. They are preferably transported away by a conveying device which is provided adjacent to the impermeable bottom.

A particularly advantageous embodiment has, between two successive transverse strips, at least one longitudinal strip or plate which is fastened to one transverse strip and which reaches as far as the other transverse strip. The longitudinal strip brings about a further subdivision of the fall-through orifices.

In order to allow the solids to be screened uniformly into two different size constituents, such that the solid fragments of the separated fine constituent do not exceed a maximum size, screen surfaces of equal size are formed by the transverse strips and longitudinal strips. For this purpose, the transverse strips and the longitudinal strips are in each case provided equidistantly.

Provided in each case on those end faces of the longitudinal strips which point away from the moving belt is a strip having a width greater than the thickness of the longitudinal strip, so that the strip overlaps its longitudinal strip.

The configuration of the strips on the longitudinal strips ensures that solid fragments cannot be jammed between the longitudinal strips, that is to say parallel to the transverse strips. A jamming cannot occur due to the overlap of the strips, in other words, because the spacing between two longitudinal strips is always greater than the spacing between the strips which are provided on the corresponding longitudinal strips. Solid fragments can be jammed only between the strips, but not between the longitudinal strips.

In order to prevent solid fragments from being jammed on those end faces of the transverse strips which point away from the moving belt, the strips are configured to be step-shaped, the lower portion of a strip being fastened to one of the longitudinal strips, and the upper portion partially overlapping the strip of the following longitudinal strip.

In a further preferred version, there is provided on that side of the separating device which is located opposite the feed device, in particular at the lower reversal point of the moving belt, a cleaning rake which is aligned essentially parallel to the transverse strips and the tines of which engage into the interspaces formed by the longitudinal strips. With the aid of the rake, solid fragments which have been jammed between the strips can therefore be effectively removed.

In order to avoid excessive stress or forces on the rake, the latter is preferably provided in such a way that it pivots away when the force exerted on it exceeds a specific value. This prevents a very tightly jammed solid fragment from damaging the rake. In a further preferred version, if the force exerted is exceeded, this not only causes the cleaning rake to be tilted away, but, at the same time, switches off the separating device, so that the jammed solid fragment may, under certain circumstances, be removed manually, and damage to the separating device is prevented.

For a particularly robust version of the separating device, the moving belt is configured as a chain and, in particular, the longitudinal strips and transverse strips are made of metal.

According to another feature of the invention, the chain has chain links and the transverse strips are fastened centrally to respective ones of the chain links such that a spacing between two of the transverse strips is smaller at the deflecting rollers on a side facing towards the deflecting rollers than the spacing between the two of the transverse strips at a point upstream from, in other words in front of, the deflecting rollers.

According to yet another feature of the invention, the transverse strips are releasably fastened to the respective ones of the chain links.

According to another feature of the invention, the at least two deflecting rollers include at least a feed-side deflecting roller, a discard-side deflecting roller, and a bottom deflecting roller downstream of the discard-side deflecting roller, and the transverse strips have a first angle of spread at the discard-side deflecting roller and a second angle of spread at the bottom deflecting roller, the first angle of spread being smaller than the second angle of spread.

According to a further feature of the invention, the at least two deflecting rollers include a discard-side deflecting roller having a stripper for preventing the solids from falling onto,the discard-side deflecting roller. The stripper is preferably an elastic stripper.

According to another feature of the invention, the moving belt has a transport region for transporting the solids; and a guide strip is provided for preventing the moving belt from sagging in the transport region.

With the objects of the invention in view there is also provided, a method for separating solids, the method includes the steps of:

providing a separating device having transverse strips fastened to a moving belt guided about deflecting rollers such that the transverse strips define fall-through orifices;

feeding solids to the separating device by depositing the solids at an acute angle, substantially parallel to a plane defined by the fall-through orifices;

separating fine solids by letting the fine solids fall through the fall-through orifices between the transverse strips;

collecting the fine solids and transporting the fine solids away with a first conveying device;

transporting coarse solids, lying on the transverse strips, in the conveying direction as far as an end-face deflecting roller; and collecting and transporting the coarse solids away with a second conveying device.

In other words, with regard to the method, the object of the invention is achieved, in that solids are fed to a separating device having a moving belt. The solids are deposited at an acute angle, substantially parallel to a plane defined by fall-through orifices. The solids are guided via deflecting rollers, and transverse strips mounted on the moving belt, fine solids falling through the fall-through orifices between the transverse strips and being collected and led away by a first conveying device, and coarse solids being transported, lying on the transverse strips, in the conveying direction as far as the end-face deflecting roller and being collected there by a second conveying device and being led away.

The advantageous embodiments presented with regard to the separating device apply accordingly to the method.

Other features which are considered as characteristic for the invention are set forth in the appended claims.

Although the invention is illustrated and described herein as embodied in a separating device for solids and a method for separating solids, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
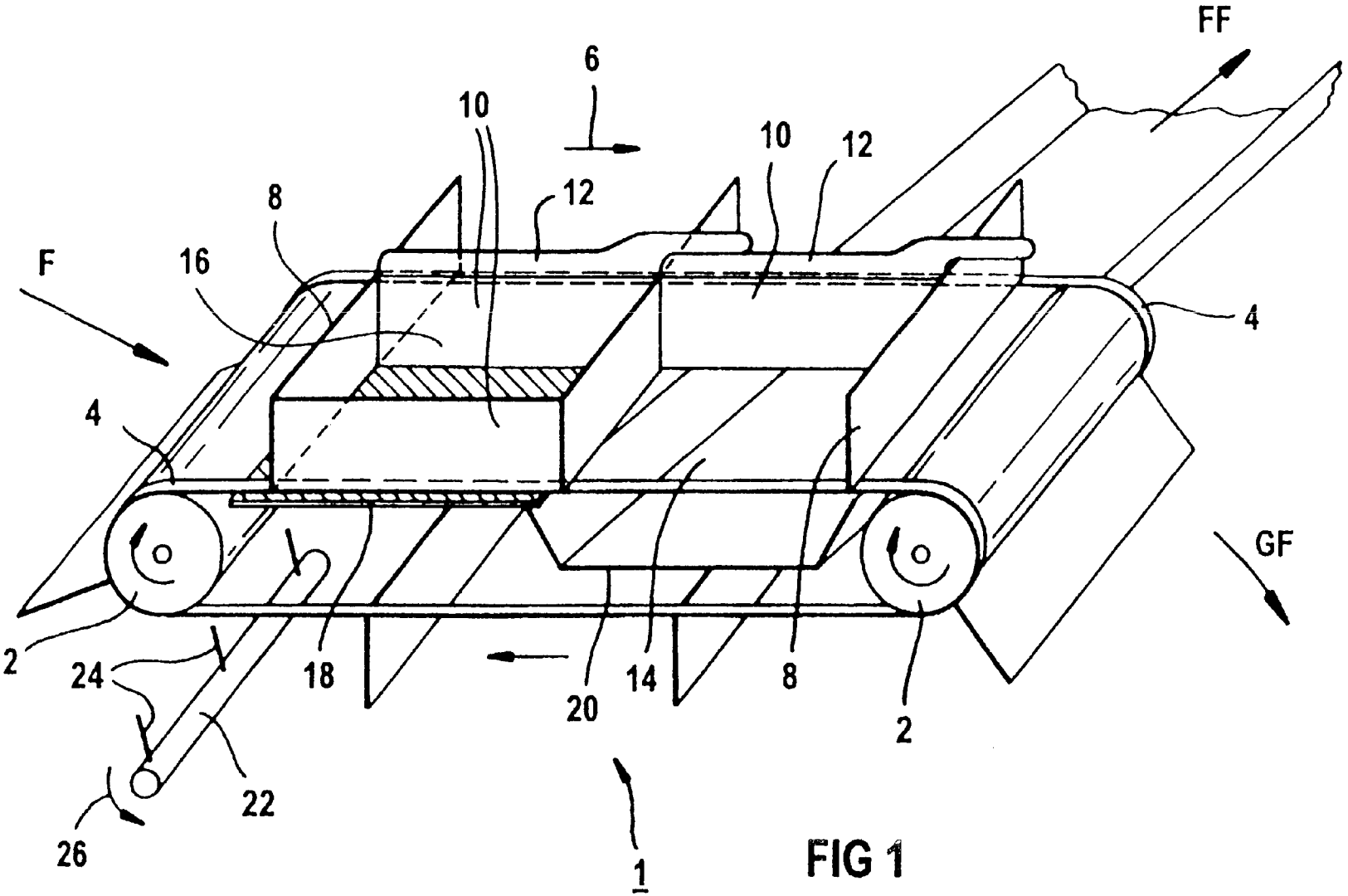
FIG. 1 is a diagrammatic perspective view of a separating device according to the invention.

Referring now to the figures of the drawings in detail and first, particularly, to FIG. 1 thereof, there is shown a separating device 1 with two deflecting rollers 2 which are spaced from one another. Two moving belts 4 running parallel to one another rotate about the deflecting rollers 2. The direction of run of the moving belts 4 corresponds to the conveying direction 6 for solids F fed onto the separating device. Transverse strips or plates 8 are mounted vertically on the moving belts 4 and transversely to the conveying direction 6. The transverse strips are in each case fastened, on their end faces, to the narrow moving belts 4, for example by a welded joint. Provided between two successive transverse strips 8 are longitudinal strips or plates 10, only three of which are shown by way of example.

The longitudinal strips 10 are preferably provided perpendicularly to the transverse strips 8 and are fitted in-between two successive transverse strips 8. The longitudinal strips 10 are fastened to one of the two transverse strips 8. Strips 12 are provided on that end face of the longitudinal strips 10 which faces away from the moving belts 4. The strips are configured to be step-shaped, successive strips 12 overlapping one another.

The transverse strips 8 and longitudinal strips 10 form elevations on the moving belts 4, the height of the longitudinal strips 10 and that of the transverse strips 8 essentially corresponding to one another. The strips 12 mounted on the longitudinal strips 10 therefore project above the transverse strips 8.

According to FIG. 1, the deflecting rollers 2 are configured as cylinders. Alternatively, a separate pair of deflecting rollers 2 may be provided for each moving belt 4. For a drive which has a little slip as possible, the deflecting rollers 2 are configured, for example, as gearwheels which engage into corresponding tooth orifices in the moving belt 4. The moving belt 4 is made, for example, from plastic, but is preferably configured as a chain with metallic chain links.

Since the moving belts 4 are configured to be narrow-banded, not sheet-like, fall-through orifices 14, which are delimited essentially by the transverse strips 8 and the longitudinal strips 10, are formed between the moving belts 4. The area spanned by the transverse strips 8 and the longitudinal strips 10 acts as a screening orifice or as a screen surface 16.

Solids F are fed in a feed region via a feed device 30 (cf. FIG. 2) and are transported in the conveying direction 6. An impermeable bottom 18 is provided in the feed region directly below the upper portion of the moving belts 4. Adjoining the bottom 18, is a first conveying device 20 for separated fine solids FF, which is illustrated as an obliquely extending chute. Alternatively, it may be configured as an active conveying device in the form of a conveyor belt or a transport worm.

A cleaning rake 22 with tines 24 is provided below the moving belts 4, in particular at the reversal point of the front deflecting roller 2. The cleaning rake 22 is mounted rotatably about its longitudinal axis, as indicated diagrammatically by the arrow 26.

The solids F applied to the separating device 1 are separated into a fine solid constituent FF and a coarse solid constituent GF. The maximum size of the fine solid constituent FF in this case corresponds to the maximum extent of the screen surfaces 16. Due to the configuration of the impermeable bottom 18 in the discharge region, the fine solid constituent FF first collects in a kind of screen box which is formed by the longitudinal strips 10, the transverse strips 8 and the bottom 18. The fine solid constituent FF accumulated in the screen box is pushed by the transverse strips 8 as far as the end of the bottom 18, where it falls through the fall-through orifices 14 onto the first conveying device 20 provided there. Coarse solid fragments GF, the dimensions of which are larger than those of the screen surfaces 16, remain lying on the longitudinal and transverse strips 8, 10, are transported further as far as the end of the separating device 1 and there fall, for example, into a second conveying device 28 (cf. FIG. 6).

Solid fragments F having unfavorable dimensions may be jammed between two successive transverse strips 8. As soon as these transverse strips 8 arrive at the end-face deflecting roller 2, the spacing between the two transverse strips 8 widens and the jammed solid fragment F falls out. By virtue of the configuration with the rotating moving belts 4, therefore, the separating device 1 automatically removes solid fragments F jammed between transverse strips 8.

Jamming is not possible between the longitudinal strips 10, since the strips 12 mounted on the longitudinal strips 10 overlap the longitudinal strips. The spacing between two strips 12 is therefore smaller than that between two longitudinal strips 10, so that solid fragments F can be jammed only between the strips 12. A solid fragment F jammed between two strips 12 provided next to one another is carried along as far as the cleaning rake 22 and is released there with the aid of the tines 24. In this case, the tines 24 engage into the interspaces formed by the longitudinal strips 10 (cf. FIG. 5). The separating device is therefore configured to be self-cleaning, even for solid fragments F jammed between the strips 12.

In an advantageous embodiment, and in order to protect the cleaning rake 22, the latter pivots away from the moving belts 4 when a critical force acts on it. This may occur when a solid fragment F is jammed particularly tightly between two strips 12. As soon as this situation occurs and the cleaning rake 22 pivots away, an automatic switch-off of the separating device may be provided. In this case, the jammed solid fragment F may be removed manually. However, if the cleaning rake 22 is of robust configuration, this situation will very seldom arise, so that the separating device ensures continuous and reliable operation.

Figure 2:
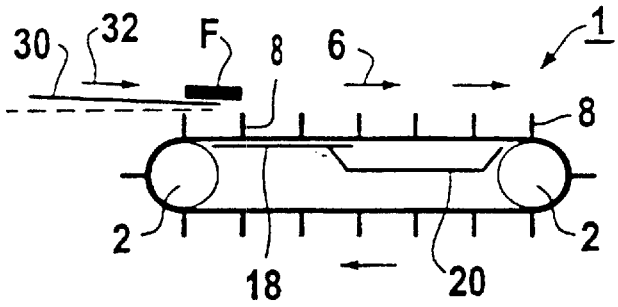
FIG. 2 is a diagrammatic side view of a separating device according to the invention.

An obliquely provided chute is illustrated in FIG. 2 as a feed device 30. It forms an acute angle with the horizontal, so that the feed direction 32 likewise forms an acute angle with the conveying direction 6. The feed device 30 terminates directly above the transverse strips 8. The essentially horizontal feed of solids F, in particular, prevents elongate solid fragments from striking the separating device 1 perpendicular to the screen surfaces 16 formed by the transverse and longitudinal strips 8, 10. The impermeable bottom 18 is provided below the feed device 30. This prevents an obliquely arriving solid fragment F from falling through downwards and ensures that the latter remains lying on one or more transverse and longitudinal strips 8, 10 and is transported further.

Figure 3:
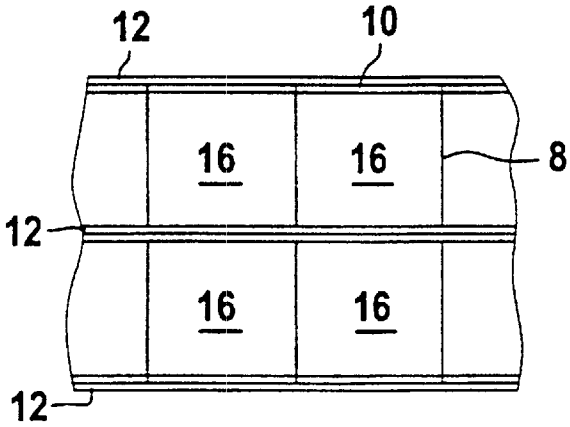
FIG. 3 is a diagrammatic, partial top view of a separating device according to the invention.

According to FIG. 3, the screen surfaces 16 formed by the transverse strips 8 and longitudinal strips 10 are configured to be of equal size and, in particular, square, in order to ensure a uniform maximum size for the fine solid constituent FF. In order to form the screen surfaces 16, the longitudinal strips 10 and the transverse strips 8 are provided in each case equidistantly from one another. In FIG. 3, the longitudinal strips 10 are covered by the overlapping strips 12.

Figure 4:
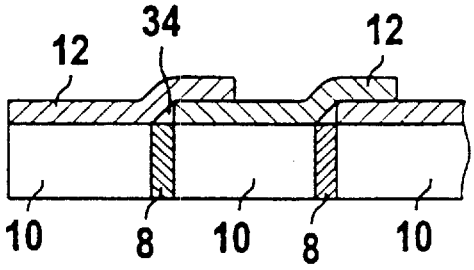
FIG. 4 is a partial sectional view of longitudinal strips with strips provided thereon.

The strips 12 having a step-shaped configuration can be seen in the side view of the longitudinal strips 10 according to FIG. 4. Here, the strip 12 of a following longitudinal strip 10 is overlapped by the strip 12 of a preceding longitudinal strip 10. The spacings caused by transverse strips 8 between the individual longitudinal strips 10 are bridged by the overlapping strips 12. This prevents the possibility of a solid fragment F being jammed in the gap, which is indicated with reference symbol 34. The strips 12 are preferably configured as round iron bars or tubes made of iron or steel.

Figure 5:
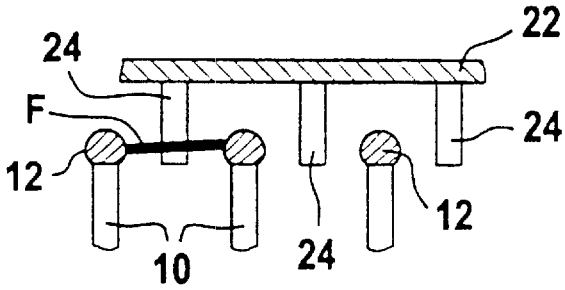
FIG. 5 is a partial sectional view of a cleaning rake engaging into the interspaces which are formed by the longitudinal strips.

FIG. 5 illustrates the cleaning rake 24 which engages with its tines 24 into the interspaces formed between the strips 12. A solid fragment F jammed between these is removed effectively through the use of the tines 24. In this case, the tines 24 engage into the interspaces only to an extent such that they reach, at most, as far as the longitudinal strips 10. Deeper engagement of the tines 24 into the interspaces would have the result that the transverse strips 8, which project from the moving belt 4 by the same distance as the longitudinal strips 10, would be caught on the tines 24.

Figure 6:
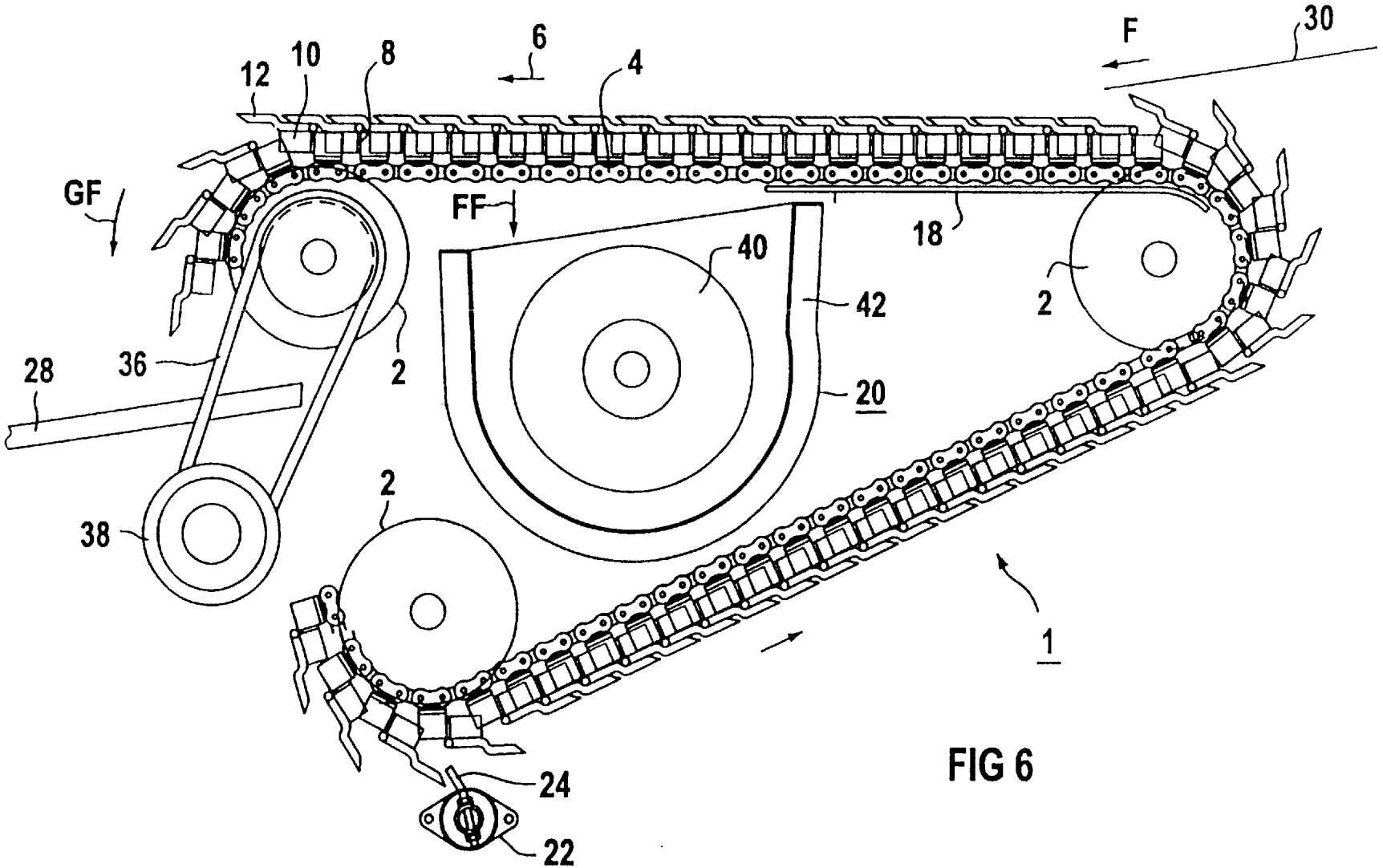
FIG. 6 is a diagrammatic side view of another embodiment of a separating device according to the invention.

An alternative embodiment of the separating device is illustrated in FIG. 6. In this embodiment, three deflecting rollers 2 are provided in such a manner that the moving belt 4 is guided in a triangle, in order to provide sufficient space for a first conveying device 20 which is as large as possible. The latter is provided in the interior spanned by the moving belt 4.

One of the deflecting rollers 2 is connected, via a drive belt 36, to a driving wheel 38 for driving the moving belt 4. The latter is not drawn fully in the region of the driving wheel 38 for the sake of greater clarity. The moving belt 4 is configured as a chain, in particular a metal chain, on the individual chain links of which the transverse strips 8 are provided. The longitudinal strips 10 having the strips 12 mounted on them are fastened to the transverse strips. The transverse strips 8 and longitudinal strips 10 are preferably made from iron or steel and are fastened to the moving belt 4 and to one another through the use of welded joints.

The solids F are fed by the feed device 30 and fall at least partially onto the impermeable bottom 18 and are transported further in the conveying direction 6. Fine solid constituents FF fall into the first conveying device 20 and are moved away by the first conveying device 20. The latter has, for example, a transport worm 40 running in a conveying trough 42.

The coarse solid constituents GF are transported further as far as the end face of the separating device 1 and there they fall onto the second conveying device 28. The latter is drawn as an oblique chute in FIG. 6. Solid fragments F which become jammed between the strips 12 can be removed with the aid of the tines 24 of the cleaning rake 22. The cleaning rake 22 is provided at the lower reversal point of the moving belt 4.

Figure 7:
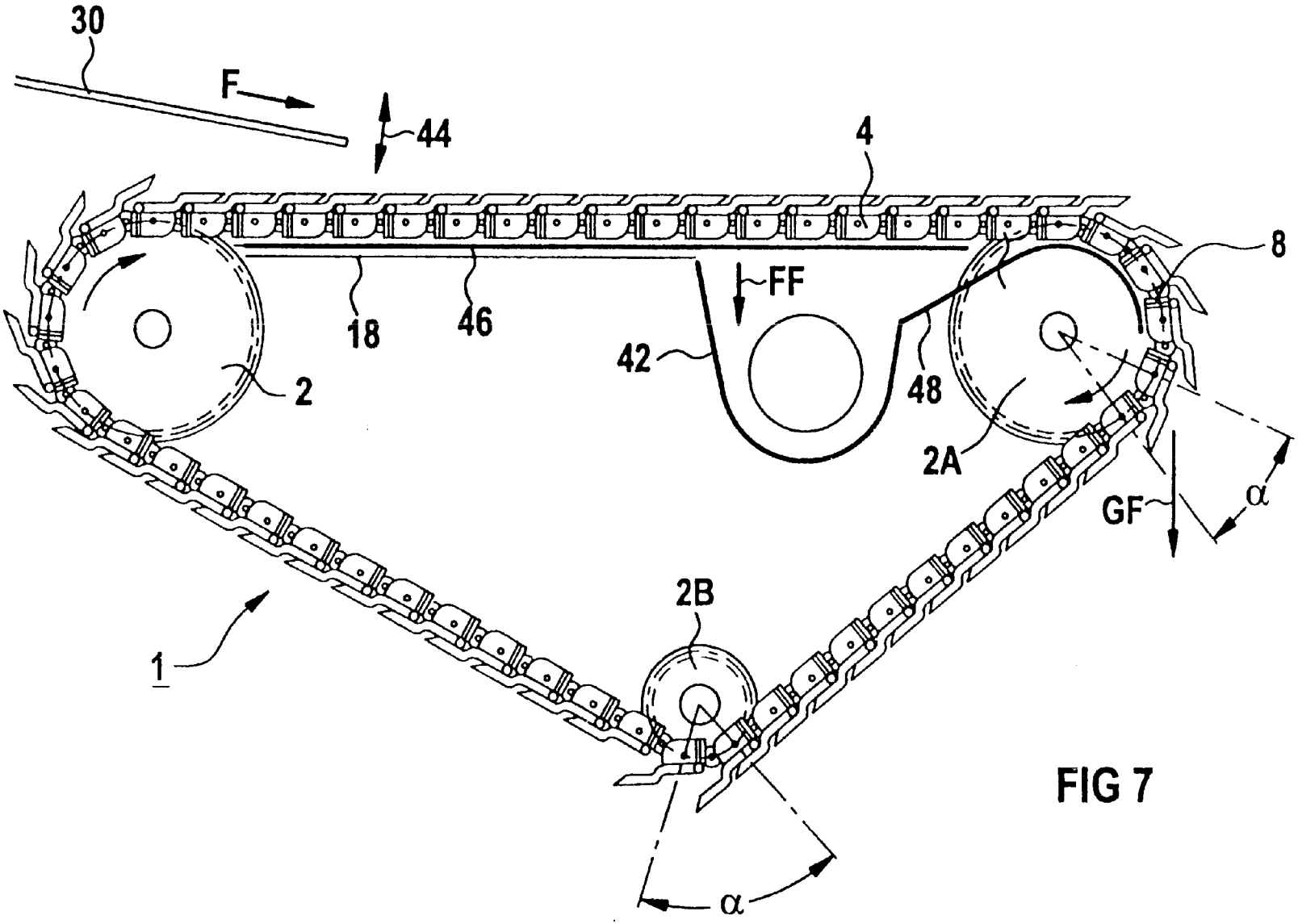
FIG. 7 is a diagrammatic side view of a modified embodiment of the separating device illustrated in FIG. 6.

The separating device 1 illustrated in FIG. 7 is similar to that illustrated in FIG. 6. Only the essential differences are dealt with below.

The feed device 30 is expediently mounted loosely, so that it is moveable along the double arrow 44. This ensures that a solid fragment which may possibly become jammed does not result in damage to the separating device 1 or the feed device 30.

The moving belt 4 is configured as a link chain. A guide strip 46 is provided, directly below the moving belt 4, on the top side of the separating device 1, where the solids F are fed and transported. The guide strip prevents the moving belt 4 from sagging. Specifically, a sag of the moving belt 4 causes the spacing between two transverse brackets to vary, so that solids may be undesirably jammed. The guide strip 46 is preferably provided directly below the link chain, so that the link chain slides on the guide strip 46 in the horizontal direction.

The bottom 18 provided in the region of the feed device 30 is configured to be vertically adjustable, so that it can always be brought as near as possible to the underside of the transverse strips 8 and longitudinal strips 10. This essentially avoids the situation where solids F are jammed between the bottom 18 and, for example, the transverse strips 8.

In the separating device 1, the angle of spread $\alpha$ of the transverse strips or brackets in the region of the discard-side deflecting roller 2A is smaller than the angle of spread α of the lower deflecting drum 2B. The angle of spread α refers to the angle which two successive transverse strips 8 form with one another. outside the region of the deflecting rollers 2, the angle of spread α amounts to 0°, since, there, the transverse strips 8 are aligned essentially parallel to one another. In the region of the deflecting rollers 2, the spacing between two successive transverse strips 8 increases on the side of the transverse strips 8 which faces away from the deflecting roller 2. It may therefore happen that a solid fragment falls between two transverse strips 8 in the region of the discard-side deflecting roller 2A and is jammed between these transverse strips 8 downstream of the deflecting roller 2A. Since the angle of spread α at the lower deflecting roller 2B is greater than at the discard-side deflecting roller 2A, this ensures that this solid fragment can be released and automatically falls out as a result of gravity.

In order to make the different angles of spread α possible, the deflecting rollers 2A, 2B are provided in a suitable way, so that they form a favorable angle with one another. Additionally or alternatively, it is advantageous if the discard-side deflecting roller 2A has a larger diameter than the lower deflecting roller 2B.

Preferably, the moving belt 4 sags slightly in the region between the deflecting roller 2A and the deflecting roller 2B and between the deflecting roller 2B and the left-hand deflecting roller 2. The result of this is that the link chain experiences a shaking movement, so that jammed solid fragments are shaken free.

Since the spacings between two successive transverse strips 8 vary in the region of the end-face deflecting roller 2A, it may happen that solid fragments are released in this region and fall onto the deflecting roller 2A. In order to protect that latter from damage, a stripper 48 is provided. The stripper 48 is placed around the deflecting roller 2A, preferably in a semicircle, and extends as far as the conveying trough 42. For this purpose, the deflecting roller 2A is configured, in particular, as a shaft with two end-face chain wheels, not as a drum of constant diameter. Moreover, in an expedient embodiment, the stripper 48 is configured to be elastic. This prevents the situation where, for example, T-shaped solid fragments lying on the transverse strips 8, but extending through the fall-through orifice 14, cause damage to the stripper 48.

Figure 8:
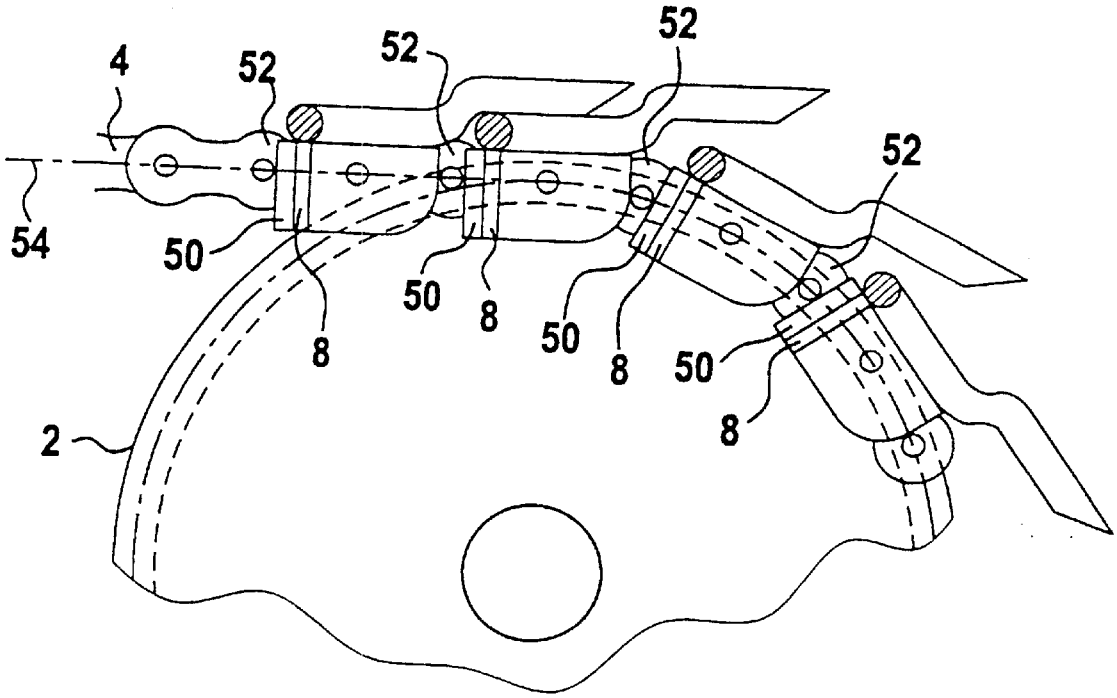
FIG. 8 is a partial side view a deflecting roller and of a moving belt.

FIG. 8 illustrates a portion of the moving belt 4, configured as a link chain, in the region of a deflecting roller 2. The deflecting roller 2 is configured, for example, as a chain wheel and is likewise illustrated merely as a detail. The individual transverse brackets 8 are fastened, in each case via a holding element 50, to a respective chain link 52. The transverse strip 8 is fastened to the holding element 50 preferably releasably and thus is easily exchangeable. The holding element 50, in turn, is firmly connected to the chain link 52, for example via a welded joint. It must be stressed that the holding element 50 is connected to the chain link 52 centrally, that is to say on the level of the chain axis 54. The result of this is that the spacing between two transverse strips on the side facing the deflecting roller 2 is smaller in the region of the deflecting roller 2 than in the region in front (upstream) of the deflecting roller 2. In the region in front (upstream) of the deflecting roller 2, the transverse strips 8 are aligned essentially parallel, as may be gathered from the left-hand half of the FIG. 8. In the region of the deflecting roller 2, two successive transverse strips 8 spread apart. As a result of the central mounting, therefore, the spacing on the underside becomes smaller, whereas it becomes larger on the top side. Solid fragments are thereby pressed out upwards. The central mounting therefore ensures that the separating device 1 is self-cleaning.

The separating device 1 is suitable, in particular, for the separation of fine solid fragments FF from the inert constituent of the pyrolysis residue occurring in a pyrolysis plant. The fine solid fragments FF may also have, in some cases, a high carbon content. The latter can be recovered, for example, by purification of the fine solids FF and can be utilized thermally for energy generation. The separated fine solid fragments FF preferably have a maximum diameter of a few centimeters.

We claim:

1. A separating device for separating solids, comprising:

at least two deflecting rollers;

a moving belt rotating about said at least two deflecting rollers, said moving belt defining a conveying direction;

transverse strips fastened to said moving belt, said transverse strips being spaced from one another and extending transversely to the conveying direction, said transverse strips defining fall-through orifices for solids, said fall-through orifices defining a plane;

a feed device for feeding the solids, said feed device being configured such that the solids are deposited at an acute angle, substantially parallel to the plane defined by said fall-through orifices;

at least one longitudinal strip disposed between two successive ones of said transverse strips, said at least one longitudinal strip being fastened to a first one of said two successive ones of said transverse strips and reaching as far as a second one of said two successive ones of said transverse strips;

said at least one longitudinal strip having a given thickness and an end face pointing away from said moving belt; and a further strip provided at said end face, said further strip having a thickness greater than said given thickness causing said further strip to overlap said at least one longitudinal strip.

2. The separating device according to claim 1, wherein:

said moving belt has an upper portion facing said feed device; and an impermeable bottom is disposed directly below said upper portion of said moving belt.

3. The separating device according to claim 2, including a conveying device for screened fine solids, said conveying device adjoining said impermeable bottom in the conveying direction.

4. The separating device according to claim 1, wherein:

said at least one longitudinal strip includes two successive longitudinal strips;

said further strip is a step-shaped strip with a lower portion and an upper portion; and said lower portion is fastened to a first one of said two successive longitudinal strips and said upper portion partially overlaps a second one of said two successive longitudinal strips.

5. The separating device according to claim 1, wherein:

said transverse strips are disposed equidistantly from one another;

longitudinal strips are disposed between respective two successive ones of said transverse strips; and said transverse strips together with said longitudinal strips define a plurality of screen areas of equal size.

6. The separating device according to claim 5, wherein:

said longitudinal strips have a given thickness and respective end faces pointing away from said moving belt; and further strips are provided at said end faces, said further strips have a thickness greater than said given thickness such that said further strips overlap said longitudinal strips.

7. The separating device according to claim 6, wherein:

said further strips are step-shaped strips each having a lower portion and an upper portion; and said lower portion is fastened to a first one of two successive ones of said longitudinal strips and said upper portion partially overlaps a second one of said two successive ones of said longitudinal strips.

8. The separating device according to claim 1, including:

a cleaning rake disposed on a side of said moving belt opposite said feed device; and said cleaning rake being aligned substantially parallel to said transverse strips and having tines engaging into interspaces formed between said longitudinal strips.

9. The separating device according to claim 8, wherein said cleaning rake pivots away from said moving belt when said moving belt exerts a force exceeding a given force on said cleaning rake.

10. The separating device according to claim 1, wherein said moving belt is a chain.

11. The separating device according to claim 10, wherein:

said chain has chain links; and said transverse strips are fastened centrally to respective ones of said chain links such that a spacing between two of said transverse strips is smaller at said deflecting rollers on a side facing towards said deflecting rollers than the spacing between said two of said transverse strips at a point upstream from said deflecting rollers.

12. The separating device according to claim 11, wherein said transverse strips are releasably fastened to said respective ones of said chain links.

13. The separating device according to claim 1, wherein said at least one longitudinal strip and said transverse strips are metal strips.

14. The separating device according to claim 1, wherein:

said at least two deflecting rollers include at least a feed-side deflecting roller, a discard-side deflecting roller, and a bottom deflecting roller downstream of said discard-side deflecting roller; and said transverse strips have a first angle of spread at said discard-side deflecting roller and a second angle of spread at said bottom deflecting roller, the first angle of spread being smaller than the second angle of spread.

15. The separating device according to claim 1, wherein said at least two deflecting rollers include a discard-side deflecting roller having a stripper for preventing the solids from falling onto said discard-side deflecting roller.

16. The separating device according to claim 15, wherein said stripper is an elastic stripper.

17. The separating device according to claim 1, wherein:

said moving belt has a transport region for transporting the solids; and a guide strip is provided for preventing said moving belt from sagging in said transport region.

18. A method for separating solids, the method which comprises:

providing a separating device having transverse strips fastened to a moving belt guided about deflecting rollers such that the transverse strips define fall-through orifices;

providing at least one longitudinal strip having a given thickness and an end face pointing away from said moving belt, the at least one longitudinal strip being disposed between two successive ones of the transverse strips, the longitudinal strips fastened to a first one of the two successive ones of the transverse strips and reaching as far as a second one of the two successive ones of the transverse strips;

providing further strips at the end faces, the further strips having a thickness greater than the given thickness causing the further strips to overlap the longitudinal strips;

feeding solids to the separating device by depositing the solids at an acute angle, substantially parallel to a plane defined by the fall-through orifices;

separating fine solids by letting the fine solids fall through the fall-through orifices between the transverse strips;

collecting the fine solids and transporting the fine solids away with a first conveying device;

transporting coarse solids, lying on the transverse strips, in a conveying direction as far as an end-face deflecting roller; and collecting and transporting the coarse solids away with a second conveying device.

* * * * *